US008636155B2

(12) United States Patent
Kern

(10) Patent No.: US 8,636,155 B2
(45) Date of Patent: Jan. 28, 2014

(54) PIVOTALLY MOUNTED STORAGE APPARATUS

(76) Inventor: William E. Kern, Wamego, KS (US)

( * ) Notice: Subject to any disclaimer, the term of this patent is extended or adjusted under 35 U.S.C. 154(b) by 243 days.

(21) Appl. No.: 13/275,020

(22) Filed: Oct. 17, 2011

(65) Prior Publication Data

US 2012/0091085 A1 Apr. 19, 2012

Related U.S. Application Data

(60) Provisional application No. 61/393,961, filed on Oct. 18, 2010.

(51) Int. Cl.
*A47F 5/08* (2006.01)

(52) U.S. Cl.
CPC ..... *A47F 5/0892* (2013.01)
USPC ..... 211/116; 211/70.8; 248/322; 248/324

(58) Field of Classification Search
USPC ..... 52/39; 211/113, 116, 118, 66, 70.8; 248/110, 126, 317, 320, 322, 324, 343, 248/911, 913
See application file for complete search history.

(56) References Cited

U.S. PATENT DOCUMENTS

| | | | | | |
|---|---|---|---|---|---|
| 336,123 | A * | 2/1886 | Leggitt | 211/113 |
| 361,630 | A * | 4/1887 | Husband | 248/110 |
| 490,851 | A * | 1/1893 | Jones | 211/66 |
| 491,891 | A * | 2/1893 | Jones | 211/66 |
| 497,667 | A * | 5/1893 | Jones | 211/66 |
| 557,567 | A * | 4/1896 | Eddy | 211/17 |
| 586,238 | A * | 7/1897 | King | 211/66 |
| 623,396 | A * | 4/1899 | Crowder | 222/144 |
| 686,639 | A * | 11/1901 | Sollars | 211/66 |
| 854,084 | A * | 5/1907 | Fletcher | 211/66 |
| 968,240 | A * | 8/1910 | Gale | 211/116 |
| 985,017 | A * | 2/1911 | Druding | 211/66 |
| 1,242,305 | A * | 10/1917 | Arey | 211/70 |
| 1,299,575 | A * | 4/1919 | Holmes | 248/113 |
| 1,719,360 | A * | 7/1929 | Deike | 211/68 |
| 3,421,632 | A * | 1/1969 | Wood | 211/70.8 |
| 3,635,433 | A * | 1/1972 | Anderson | 211/70.8 |
| 3,900,110 | A * | 8/1975 | Soroka | 211/113 |
| 4,003,612 | A * | 1/1977 | Munsell | 312/245 |
| 4,244,301 | A * | 1/1981 | Nakatsu | 108/149 |
| 4,286,717 | A * | 9/1981 | Liesinger | 211/70.6 |
| 4,603,507 | A * | 8/1986 | Nelson | 47/67 |
| 5,107,996 | A * | 4/1992 | Whittaker | 211/116 |
| 5,117,988 | A * | 6/1992 | Daniels | 211/113 |
| 5,168,642 | A * | 12/1992 | Hansen | 34/239 |
| 5,257,700 | A * | 11/1993 | Wallace | 211/70.8 |
| 6,250,480 | B1 * | 6/2001 | McGuinness | 211/70.8 |
| 6,510,953 | B2 * | 1/2003 | Daniels | 211/60.1 |
| 2005/0139742 | A1 * | 6/2005 | Frisell | 248/317 |
| 2009/0242500 | A1 * | 10/2009 | Li | 211/116 |

* cited by examiner

*Primary Examiner* — Michael Safavi
(74) *Attorney, Agent, or Firm* — Dale J. Ream

(57) ABSTRACT

A storage apparatus includes an elongate support rod pivotally mounted to a roof or ceiling structure for movement between a storage configuration adjacent and generally parallel to a ceiling and an extended configuration generally perpendicular to the ceiling. Upper and lower support members are attached to the support rod and are configured to removably hold items such as fishing rods. The support apparatus includes a capture member also mounted to the ceiling structure for releasably holding the support rod at the storage configuration.

18 Claims, 6 Drawing Sheets

PIVOTALLY MOUNTED STORAGE APPARATUS

REFERENCE TO RELATED APPLICATIONS

This application claims the benefit of provisional patent application Ser. No. 61/393,961 filed on Oct. 18, 2010, titled Storage Rack.

BACKGROUND OF THE INVENTION

This invention relates generally to storage apparatuses and, more particularly, to an apparatus mountable to a support beam or ceiling of a garage or barn for holding, organizing, and storing fishing poles above a floor surface and which is movable between storage and use positions.

A garage often becomes so full of miscellaneous items, such as bicycles, tool boxes, lawn mowers, and recreation equipment, that it is difficult to still use the garage for its traditional purpose of parking cars therein to keep them out of the weather elements. In addition to the clutter and inability to use the garage for its intended purpose, it may become very difficult to find the very items that were stored in the garage for convenience sake to begin with. For instance, multiple fishing rods may be stored in a garage or barn area for the convenience of having them immediately available; however, they may contribute to the overall clutter of the garage and may, in fact, become lost.

Various devices have been proposed in the art for organizing and storing items commonly stored in a garage. For example, cabinets, systems of bins, and other similar organizational structures are commonly used to store fasteners and other small items on a workbench or against walls. Although assumably effective for their intended purposes, the existing devices are not effective to store long or awkward items such as fishing rods or, more importantly, to store them out of the way of cars parked in the garage.

Therefore, it would be desirable to have a storage apparatus for organizing and storing multiple fishing rods out of the way of vehicles within a garage or barn. Further, it would be desirable to have a storage apparatus that is movable between a storage position horizontally adjacent a ceiling or rafters of a garage and a use position vertically extending downward from the ceiling or rafters. In addition, it would be desirable to have a storage apparatus that includes multiple fishing rod holding stations.

SUMMARY OF THE INVENTION

A storage apparatus according to the present invention includes an elongate support rod pivotally mounted to a roof or ceiling structure for movement between a storage configuration adjacent and generally parallel to a ceiling and an extended configuration generally perpendicular to the ceiling. Upper and lower support members are attached to the support rod and are configured to removably hold items such as fishing rods. The support apparatus includes a capture member also mounted to the ceiling structure for releasably holding the support rod at the storage configuration.

Therefore, a general object of this invention is to provide a storage apparatus for selectively storing fishing rods out of the way in a garage.

Another object of this invention is to provide a storage apparatus, as aforesaid, that is pivotally movable between a storage position horizontally adjacent a ceiling or rafters of a garage and a use position vertically extending downward from the ceiling or rafters.

Still another object of this invention is to provide a storage apparatus, as aforesaid, that securely holds multiple fishing rods in both the storage and use positions.

Yet another object of this invention is to provide a storage apparatus, as aforesaid, that is easy to use and economical to manufacture.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
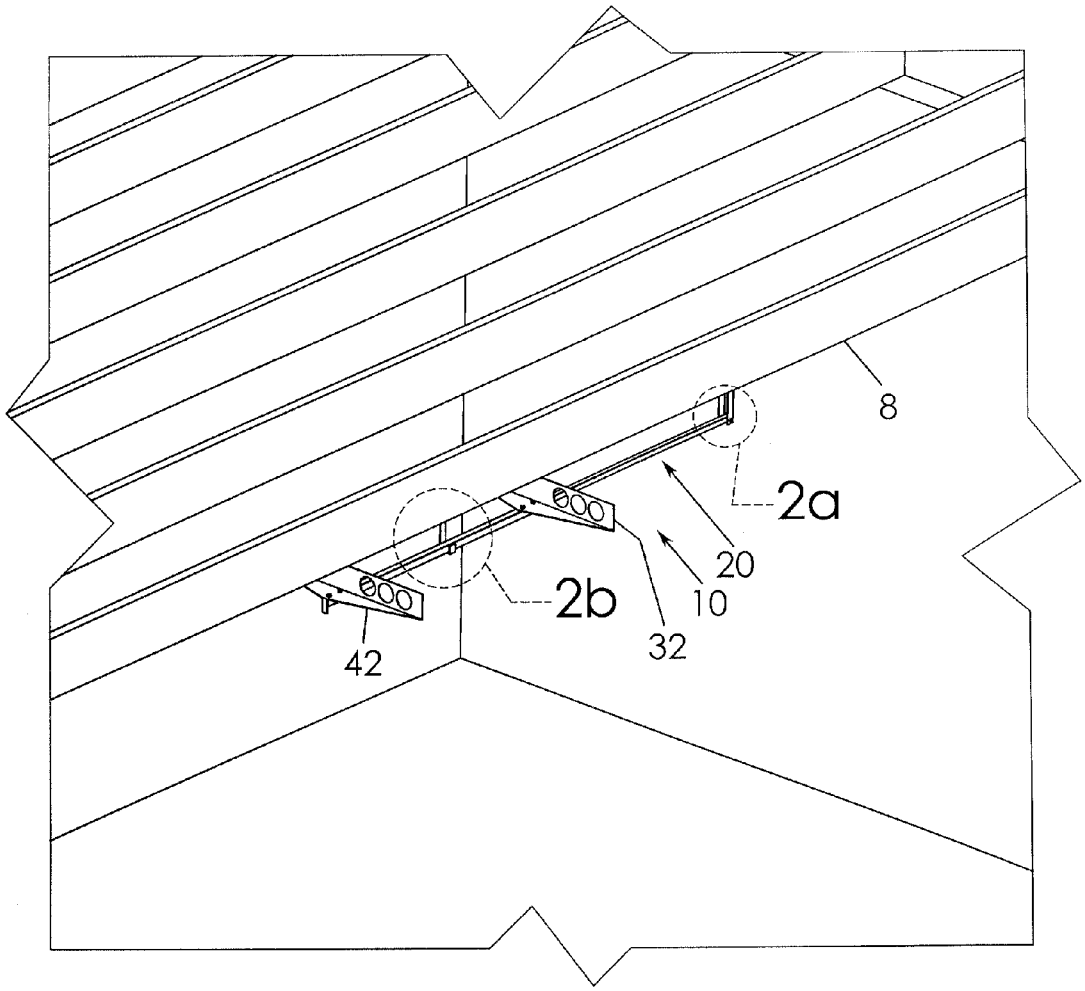
FIG. 1 is a fragmentary perspective view of a storage apparatus according to a preferred embodiment of the present invention shown in a storage configuration in a garage.

A storage apparatus according to a preferred embodiment of the present invention will now be described with reference to FIGS. 1 to 4 of the accompanying drawings. The storage apparatus 10 includes a support rod 20, upper 32 and lower 42 support members, and a mounting member 50.

The support rod 20 includes a linear elongate configuration that may be constructed of a lightweight metal although a wooden construction may also be suitable. The support rod 20 includes upper 27 and lower 23 ends. More particularly, the support rod 20 includes a lower portion 22 coupled to an upper portion 26 although a single member construction would also work. The upper end 27 of the support member in general also refers to the upper end 27 of the upper portion 26 of the support rod 20. Similarly, the lower end 23 of the support rod 20 also refers to the lower end 23 of the lower portion 22 of the support rod 20. An upper end 24 of the lower portion 22 may be configured to receive a lower end 28 of the upper portion such that the lower 22 and upper 26 portions may be coupled together with fasteners 30 such as bolt and nut combinations. The support rod 20 may have a hollow configuration and may be length adjustable.

The upper 32 and lower 42 support members include substantially similar configurations. Preferably, each support member 32, 42 includes a mounting portion 34, 44 integrally connected to a holder portion 36, 46. Respective mounting portion 34, 44 may also be referred to as back sides having planar configurations attachable to the support rod 20. Respective holder portion 36, 46 may also be referred to as top sides having planar configurations integrally connected to respective back sides. Each holder portion 36, 46 may include a planar surface defining a plurality of apertures 38, 48 each aperture 38, 48 preferably being sized to receive a fishing pole. However, the apertures 48 in the lower holder portion 42 may include dimensions that receive the reel end of a respective fishing pole but that doesn't allow the pole to slide completely therethrough.

Figure 2A:
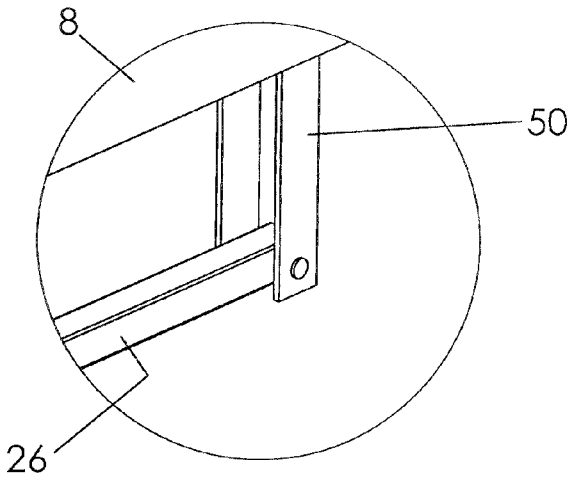
FIG. 2*a* is an isolated view on an enlarged scale taken from a portion of FIG. 1.
Figure 2B:
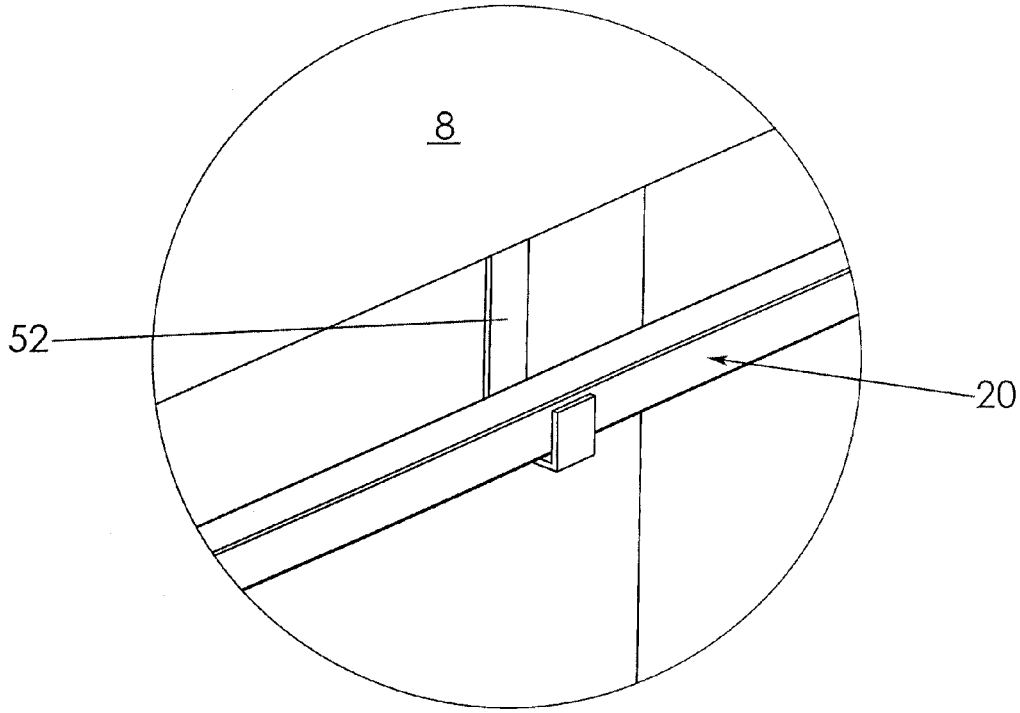
FIG. 2*b* is an isolated view on an enlarged scale taken from a portion of FIG. 1.
Figure 3:
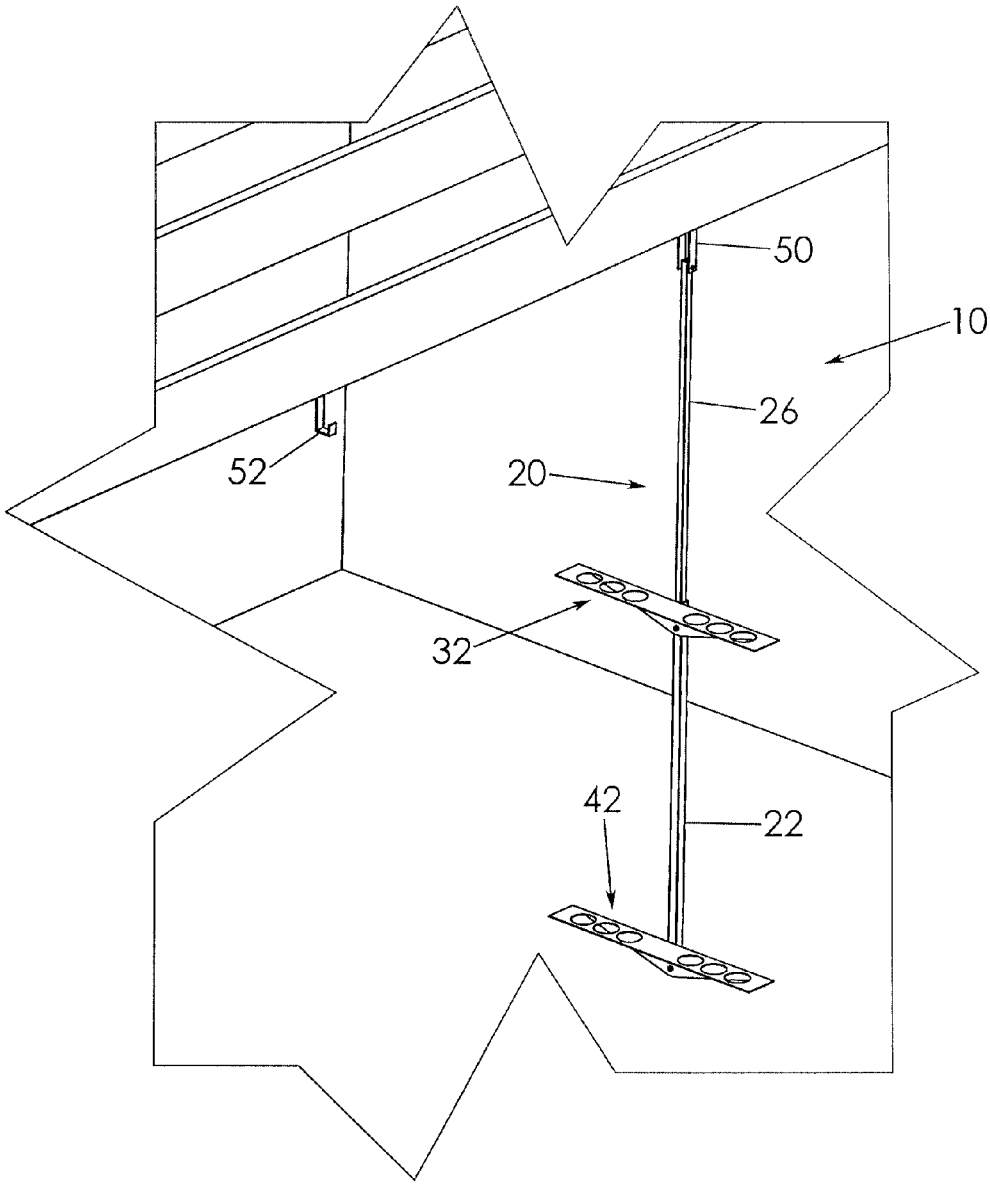
FIG. 3 is another fragmentary perspective view of the storage apparatus as in FIG. 1 shown in an extended configuration.
Figure 4:
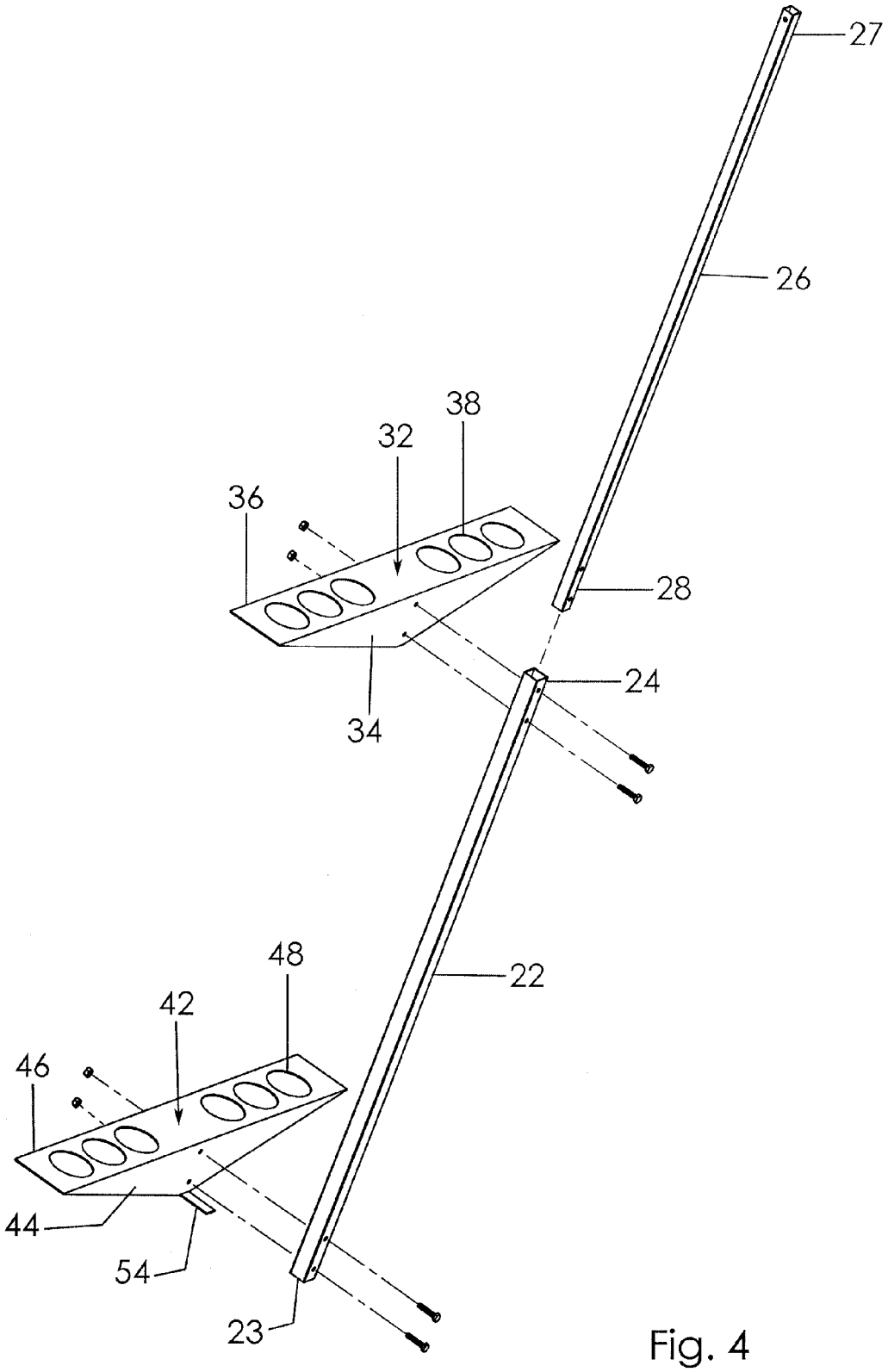
FIG. 4 is an exploded view of the storage apparatus as in FIG. 3 removed from the storage structure.

As particularly shown in FIG. 2*a*, the mounting member 50 may be a U-shaped bracket that is at one end attached to a rafter 8, ceiling framing stud, beam, girder or the like, such as the framework of a garage, barn, or other storage structure. An opposed end of the mounting member 50 is pivotally coupled to an upper end 24 of the upper portion 26 of the elongate support rod 20. In other words, the support rod 20 is pivotally movable relative to the mounting member 50 between a storage configuration in which the support rod 20 is generally parallel to the rafter 8 or ceiling (FIG. 1) and an extended or released configuration in which the support rod 20 is generally perpendicular to the rafter 8 (FIG. 3).

The storage apparatus 10 also includes a capture member 52 configured to releasably hold the support rod 20 at the storage configuration. More particularly, the capture member 52 may be a bracket having a J-shaped configuration and coupled to the same rafter 8 as the mounting member 50 but displaced therefrom. In other words, the capture member 52 defines a generally open side and a recessed area such that the support rod 20 may be at first lifted over a terminal lip of the bracket and rested in the recessed area that holds the rod 20 in the storage configuration until the support rod 20 is again lifted up and moved out of the recessed area as it is being moved to the extended or deployed configuration.

The storage apparatus 10 may also include a flange 54 coupled to the lower support member 42 or, alternately, to the lower portion 22 of the support rod 20. Another alternative to the flange 54 would be to utilize an elongate bolt (unnumbered) for coupling the lower support member 42 to the support rod 20 such that the extra length of bolt may be utilized in the manner of the flange 54 described herein. The flange 54 preferably includes a configuration for coupling with an end of a guide rod (not shown), the guide rod enabling a user to pivot the support rod 20 from the extended configuration to the storage configuration or vice versa. In other words, a person's arms are not long enough to push the support rod 20 to its position adjacent the ceiling or to release the support rod 20 from the storage position so that it can pivot to the extended position in a controlled descent. It is understood that the guide rod may be a conventional piece of PVC conduit or the like.

In use, the storage apparatus 10 may be mounted to a roof or ceiling structure such as a rafter or roof support beam. The mounting member 50 is pivotally coupled to the support rod 20 such that the support rod 20 may be pivoted between storage (FIG. 1) and extended (use) (FIG. 3) configurations. Accordingly, the storage apparatus 10 may at first be positioned in the use configuration so that one or more fishing poles may be placed into corresponding apertures 38, 48 of the upper 32 and lower 42 support members. Then, the support rod 20 may be moved to the storage configuration which is up and out of the way of vehicles, persons, or other articles in the garage.

Figure 5:
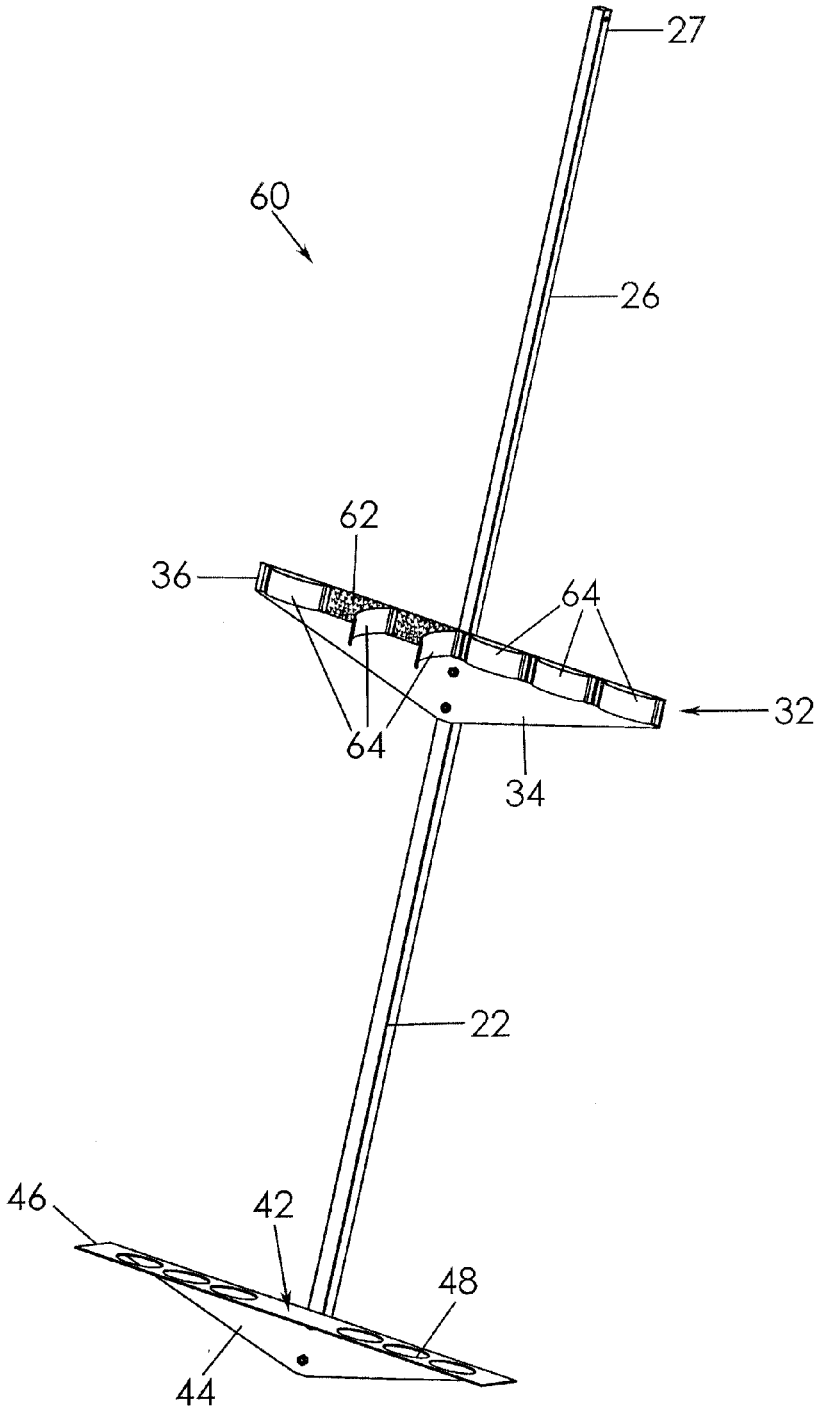
FIG. 5 is a perspective view of a storage apparatus according to another embodiment of the preferred embodiment of the present invention.
Figure 6:
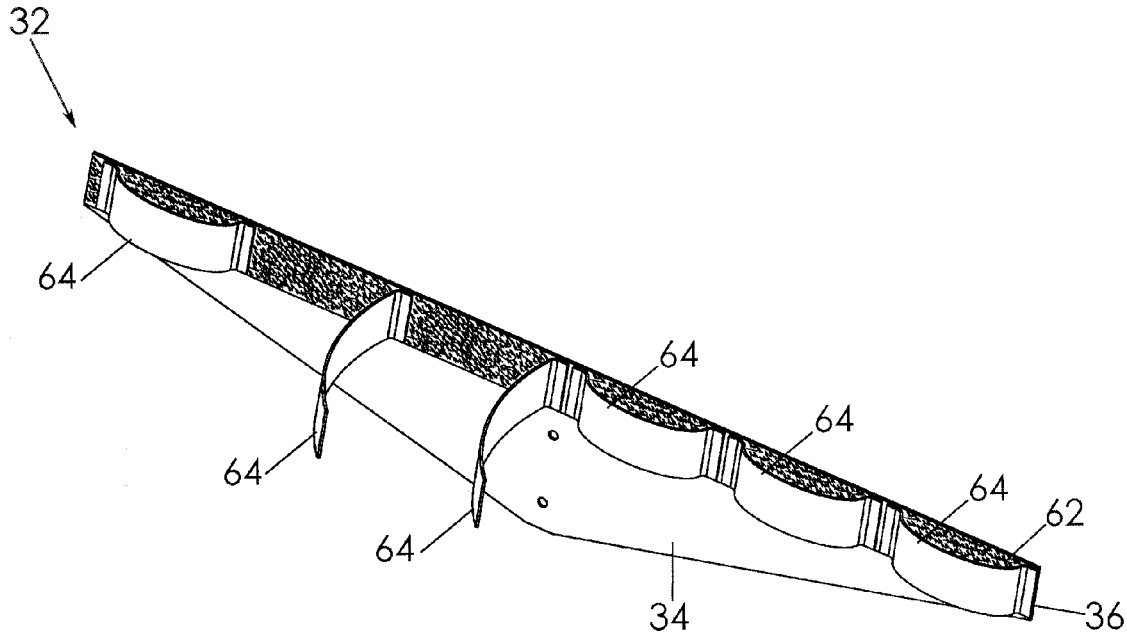
FIG. 6 is an isolated view on an enlarged scale of an upper support member as in FIG. 5.

Another embodiment of the storage rack 60 is shown in FIGS. 5 and 6 and includes a construction substantially like that described above except as specifically noted below. The same reference will be used for components that are unchanged. In the storage rack 60 according to the embodiment shown in FIG. 5, the upper support member 32 includes a system of hook and loop fasteners to selectively secure articles instead of apertures 38. More particularly, the upper member holding portion 36 includes a plurality of holding members that are configured to selectively secure to individually secure a respective article, such as an article of fishing gear, e.g. a fishing rod.

The plurality of holding members may include a fastener 62 and a plurality of individual straps 64 as described more fully below. The fastener 62 may include an elongate strip of hook and loop material that extends between lateral edges of the upper member holding portion 36 adjacent an upper edge of thereof. Further, the holding members may include a plurality of individual straps 64 having opposed ends. Specifically, one end of each strap 64 is attached to the upper member holding portion 36 or, in the alternative, attached (such as by adhesive or sewing) to the fastener/strip 62 while the remainder of the individual strip and free end thereof extend away from the upper member holding portion 36. Each individual strap 64, therefore, includes a flexible construction. Further, each strap 64 also includes a hook and loop material complementary to the hook and loop material of the fastener/strip 62. For instance, if the fastener 64 includes a hook material, then each strap preferably includes loop material.

In use, an article of fishing gear, such as a fishing rod, may be positioned in the lower support member 42 as described above such that an upper end of the rod extends adjacent to an associated individual strap 64 of the holding members. The respective individual strap 64 may then be moved from an unsecured configuration extending away from the upper support member 32 to a secured configuration capturing the respective rod and securing it against the upper support member 32. In doing so, the individual strap 64 is releasably secured to the fastener/strip 62 in a hook and loop fastener engagement. It is understood that the individual straps 64 are spaced apart from one another sufficiently so as not to interfere with one another.

It is understood that while certain forms of this invention have been illustrated and described, it is not limited thereto except insofar as such limitations are included in the following claims and allowable functional equivalents thereof.

The invention claimed is:

1. A support apparatus for use in storing articles above a floor surface in a storage structure, comprising:

a mounting member configured to be attached to a beam inside the storage structure;

an elongate support rod having opposed upper and lower ends, said upper end being pivotally coupled to said mounting member, wherein said support rod is pivotally movable between a storage configuration at which said support rod is generally parallel to said beam and an extended configuration at which said support rod is generally perpendicular to said beam;

a capture member displaced from said mounting member and configured to be attached to the beam inside the storage structure, said capture member being configured to receive said support rod when said support rod is at said storage configuration;

an upper support member having an upper member mounting portion attached to said support rod displaced from said lower end thereof and having an upper member holding portion connected to said upper member mounting portion, said upper member holding portion defining a plurality of upper member apertures configured to secure articles positioned to extend through respective upper member apertures; and a lower support member having a lower member mounting portion attached to said support rod adjacent said lower end and having a lower member holding portion connected to said lower member mounting portion, said lower member holding portion defining a plurality of lower member apertures configured to secure articles positioned to extend through respective lower member apertures.

2. The support apparatus as in claim 1, wherein:

said support rod includes a lower portion having an upper end and a generally hollow configuration;

said support rod includes an upper portion having a lower end;

wherein said lower portion upper end is configured to receive said upper portion lower end; and said lower and upper portions of said support rod are be removably coupled together with a fastener.

3. The support apparatus as in claim 2, wherein said upper portion is slidably movable relative to said lower portion such that said support rod is length adjustable.

4. The support apparatus as in claim 1, further comprising a guide flange coupled to said lower support member and extending outwardly, said guide flange having a configuration to enable a user to move said support rod between said storage and extended configurations.

5. The support apparatus as in claim 1, wherein:

said lower member mounting portion of said lower support member is a back side having a generally planar configuration; and said lower member holding portion of said lower support member is a top side having a generally planar configuration, said top side being integrally connected and perpendicular to said top side.

6. The support apparatus as in claim 5, wherein:

said upper member mounting portion of said upper support member is a back side having a generally planar configuration; and\ said upper member holding portion of said upper support member is a top side having a generally planar configuration, said top side being integrally connected and perpendicular to said top side.

7. The support apparatus as in claim 1, wherein said lower member apertures have diameters different than diameters of said upper member apertures so that said lower member apertures receive a fishing pole without allowing said fishing pole to slide completely therethrough.

8. The support apparatus as in claim 1, wherein said mounting member is a bracket having a generally U-shaped configuration and defining an open end at which said upper end of said support rod is pivotally mounted.

9. The support apparatus as in claim 1, wherein said capture member includes a generally J-shaped configuration that defines a generally open side and a recessed area such that said support rod is passed through said open side and into said recessed area when moved from said extended configuration to said storage configuration.

10. The support apparatus as in claim 1, wherein said lower and upper support members are spaced apart from one another and coupled to said support rod in vertical alignment with one another.

11. A support apparatus for use in storing articles of fishing gear above a floor surface in a storage structure, comprising:

mounting member configured to be attached to a beam inside the storage structure;

an elongate support rod having opposed upper and lower ends, said upper end being pivotally coupled to said mounting member, wherein said support rod is pivotally movable between a storage configuration at which said support rod is generally parallel to said beam and an extended configuration at which said support rod is generally perpendicular to said beam;

a capture member displaced from said mounting member and configured to be attached to the beam inside the storage structure, said capture member being configured to receive said support rod when said support rod is at said storage configuration;

an upper support member having an upper member mounting portion attached to said support rod displaced from said lower end thereof and having an upper member holding portion connected to said upper member mounting portion, said upper member holding portion including a plurality of holding members configured to individually secure a respective article of fishing gear; and a lower support member having a lower member mounting portion attached to said support rod adjacent said lower end and having a lower member holding portion connected to said lower member mounting portion, said lower member holding portion defining a plurality of lower member apertures configured to secure articles of fishing gear positioned to extend through respective lower member apertures.

12. The support apparatus as in claim 11, wherein said plurality of holding members define a plurality of upper member apertures configured to secure articles of fishing gear positioned to extend through respective upper member apertures.

13. The support apparatus as in claim 12, wherein said lower member apertures have diameters different than diameters of said upper member apertures so that said lower member apertures receive a fishing pole without allowing said fishing pole to slide completely therethrough.

14. The support apparatus as in claim 11, wherein said plurality of holding members includes:

a fastener extending between lateral edges of said upper member holding portion having one of a hook and loop material therealong; and a plurality of individual straps attached at one end to said upper member holding portion adjacent said fastener and extending away from said upper member holding portion, each said strap including another of said hook and loop material that is complementary to said hook and loop material of said fastener such that a respective individual strap is selectively wrapped around a respective article of fishing gear that is positioned to extend upwardly adjacent said respective individual strap so as to releasably secure said respective article of fishing gear to said upper member holding portion.

15. The support apparatus as in claim 11, wherein said mounting member is a bracket having a generally U-shaped configuration and defining an open end at which said upper end of said support rod is pivotally mounted.

16. The support apparatus as in claim 11, wherein said capture member includes a generally J-shaped configuration that defines a generally open side and a recessed area such that said support rod is passed through said open side and into said recessed area when moved from said extended configuration to said storage configuration.

17. The support apparatus as in claim 11, wherein said lower and upper support members are spaced apart from one another and coupled to said support rod in vertical alignment with one another.

18. The support apparatus as in claim 14, wherein:

each strap of said plurality of straps are spaced apart from one another so as not to interfere with one another;

each said strap has a flexible construction and is movable between an unsecured configuration extending away from said upper mounting member and a secured configuration releasably engaged in a hook and loop engagement with said fastener.

* * * * *